US005308056A

United States Patent [19]

Achelpohl

[11] Patent Number: 5,308,056

[45] Date of Patent: May 3, 1994

[54] APPARATUS FOR STACKING FLAT WORKPIECES ON A STACKING TABLE

[75] Inventor: Fritz Achelpohl, Lengerich, Fed. Rep. of Germany

[73] Assignee: Windmoller & Holscher, Lengerich, Fed. Rep. of Germany

[21] Appl. No.: 913,420

[22] Filed: Jul. 15, 1992

[30] Foreign Application Priority Data

Jul. 15, 1991 [DE] Fed. Rep. of Germany ..... 4123399

[51] Int. Cl.[5] ..... B65H 29/68

[52] U.S. Cl. ..... 271/183; 271/196; 271/314

[58] Field of Search ..... 271/82, 182, 183, 196, 271/314, 306, 194

[56] References Cited

U.S. PATENT DOCUMENTS

| | | | |
|---|---|---|---|
| 2,113,650 | 4/1938 | Golber | 271/183 X |
| 2,130,841 | 9/1938 | Eckhard | 271/183 |
| 3,730,517 | 5/1973 | Norton | 271/183 |
| 4,116,430 | 9/1978 | Winchester et al. | 271/196 X |
| 4,132,403 | 1/1979 | Weisbach et al. | 271/196 X |
| 4,629,175 | 12/1986 | Fischer et al. | 271/82 X |
| 5,141,221 | 8/1992 | Mack et al. | 271/314 X |
| 5,186,107 | 2/1993 | Wieland | 271/82 X |

FOREIGN PATENT DOCUMENTS

| | | | |
|---|---|---|---|
| 1963712 | 7/1971 | Fed. Rep. of Germany | 271/183 |

*Primary Examiner*—D. Glenn Dayoan
*Assistant Examiner*—Boris Milef
*Attorney, Agent, or Firm*—Keck, Mahin & Cate

[57] ABSTRACT

An apparatus is disclosed for stacking flat workpieces, which are conveyed on a transport cylinder provided with holding tongs, on a stacking table put against the transport cylinder. The apparatus is provided with a control for opening the holding tongs before reaching the stacking table, and with a braking arrangement for decelerating the workpieces such that the workpieces are set down on the stacking table at a lower speed than the peripheral speed of the transport cylinder. In accordance with the invention the braking arrangement consists of a row of suction nozzles or a suction belt circulating at a lower speed that the transport cylinder.

5 Claims, 2 Drawing Sheets

APPARATUS FOR STACKING FLAT WORKPIECES ON A STACKING TABLE

BACKGROUND OF THE INVENTION

The invention relates to an apparatus for stacking flat workpieces, which are conveyed on a transport cylinder provided with folding tongs, on a stacking table put against the transport cylinder or on stacking arms put against the same which are parallel to each other. The bags or sacks may be provided with a glued bottom, made by the folding-tongs and the apparatus is provided with a means for opening the folding tongs before reaching the stacking table, and with a means for decelerating the workpieces such that the workpieces are set down on the stacking table at a lower speed than the peripheral speed of the transport cylinder.

An apparatus for collecting bags, which were made on a folding-tongs cylinder and are provided with glued bottom, on a stacking table put against the folding-tongs cylinder is, for instance, known f-rom the U.S. Pat. No. 2,087,704. In this known apparatus the bags are released by the folding tongs shortly before reaching the stacking table, so that their leading bottom hits the stacking table almost unretarded at the peripheral speed of the folding-tongs cylinder. When the bags consist of a softer material, the edges hitting the stacking table can therefore get creased or upset.

To prevent a waving, bending or folding of the workpieces set down on the stacking table with their leading edges, an apparatus of the above-mentioned type, which is known from the DE-AS 10 54 818, is provided with tappets having elastic pads mounted on a swivelling frame, which in synchronism with the workpieces being set down are put against the periphery of the folding-tongs cylinder such that they exert a braking torque on the workpieces released by the folding tongs. The braking force exerted by the tappets on the end portion of the workpieces to be decelerated depends, however, on the magnitude of the contract pressure on the folding-tongs cylinder which passes with friction under the decelerated workpiece, so that mutually opposite frictional forces of different magnitudes, which can distort the workpiece, are acting on the two sides of the workpiece, which is disadvantageous in particular, when the same is thin-walled and/or double-walled, as this is the case for instance with bags or sacks.

SUMMARY OF THE INVENTION

It is the object of the invention to provide an apparatus of the above described kind, by means of which workpieces or bags can be carefully decelerated such that they can be set down on the stacking table substantially shockfree.

In accordance with the invention, in an apparatus of the above described kind, the braking means consists of a row of suction nozzles or a suction belt circulating at a lower speed than the transport or folding-tongs cylinder. The braking means provided in the inventive apparatus, which consists of a suction means, comes in engagement with the workpiece to be decelerated almost frictionless, because the braking force is no longer exerted by jaw-like cooperating members, which both are in frictional engagement with the two sides of the workpiece to be decelerated, where only the difference of the frictional forces acts as braking force. With the apparatus in accordance with the invention it is thus possible to also manufacture workpieces of a soft material or bags of a thin, limp or creasing material with a high output, i.e. a high number of cycles, and to set down the same on the stacking table almost shock-free.

In accordance with an advantageous embodiment of the invention it is provided that at least two suction pipes provided with suction nozzles at their ends are pivotally mounted about an axis of the transport cylinder which is eccentric with respect to the axis of the transport cylinder and extends parallel thereto, and are controlled such that they make a swivel movement which decelerates the bags attached by the suction of said suction nozzles and is superimposed on the rotation. For controlling said swivel movement the suction pipes or the shaft carrying the same can be connected with a lever carrying on its end a sliding pad or a roller, which are running on a stationary cam. The cam is expediently designed such that it decelerates the suction nozzles in the direction of the stacking table down to zero or almost zero.

The supply of suction air to the suction nozzles is expediently controlled such that the same is interrupted at the moment of or shortly before the bottom edges of the workpieces hitting the stacking table. The interruption is expediently affected at the moment when the suction nozzles have reached their lowest speed relative to the stacking table or even the speed zero.

In accordance with a particularly advantageous embodiment it is provided that the eccentricity of the swivel axis of the suction nozzles and the cam characteristic are chosen such that the suction nozzles make a setting-down movement which is about tangential wit respect to the transport cylinder and about vertical with respect to the stacking table. As a result of this design, the suction nozzles are lifting the workpiece off the transport cylinder, so that they no longer follow the circular path of the transport cylinder and can be set down on the stacking table in tangential direction with respect to the transport cylinder. This lifting-off facilitates the setting down of the workpieces behind deflection fingers, which are usually provided at the stacking table at right angels thereto and engage in peripheral grooves in the transport cylinder.

To provide that the suction pipes cannot swivel freely during the uncontrolled circulation with the transport cylinder, there are provided stop members connected with the same or with the suction nozzle shaft, which outside the range of action of the cam rest against an abutment of the transport cylinder by spring force.

In accordance with another embodiment of the invention, at lease one suction belt is provided, which is substantially tangentially put against the transport cylinder, and whose conveying strand running over a suction box extends about at right angles to the stacking table. Said stationarily mounted suction belt decelerates the workpieces before they are set down on the stacking table.

Expediently, the suction belt/belts partly engages-/engage in peripheral grooves in the transport cylinder, so that an uninterrupted movement of the leading edges of the workpieces released by the transport tongs onto the suction belt/belts is ensured.

Expediently, the speed of the suction belts and the supply of suction air to the same can be controlled. The control is effected such that after the leading portion of the workpieces has been attached by suction, the suction belt/belts make a decelerating movement, and the supply of suction air is interrupted at the moment of or shortly before the workpieces hitting the stacking table.

In a further embodiment of the invention it is provided that a transport roller can be put against the transport cylinder for pushing the workpiece after it has been released by the holding tongs.

DESCRIPTION OF PREFERRED EMBODIMENTS

Figure 1:
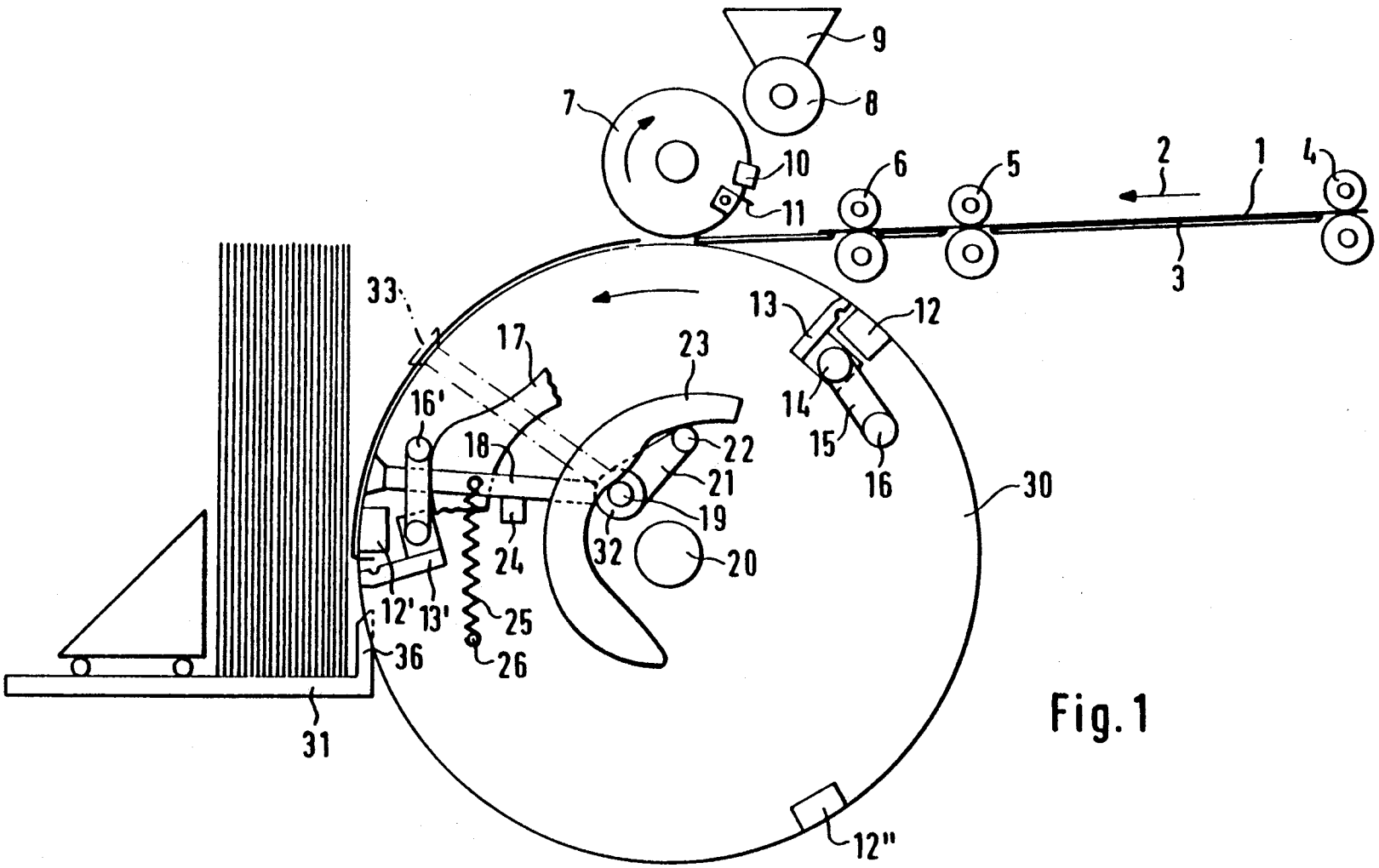
FIG. 1 is a schematic side view of an apparatus for manufacturing and stacking bags or sacks provided with reversed or glued bottoms.

By means of the apparatus schematically represented in FIG. 1 there are manufactured from a tubular web 1, for example a tubular paper web provided with a longitudinal glued seam, bags or sacks provided with reversed or glued bottom folds. The tubular web 1 can be provided with side folds, the walls being provided with mutually offset perforation lines, so that after bag lengths have been torn off from the tubular web 1 sections are obtained where the open ends overlap each other.

The tubular web 1 is moved forward by a pair of transport rollers 4 and is conveyed in the direction of the arrow 2 on a table 3. By means of two pairs of web-breaking rollers 5, 6 sack or bag workpieces are then torn off from the tubular web I along transverse perforation lines, when the transverse perforation lines are between the roller pairs 5, 6. For tearing off, the tubular web is held by the roller pair 5, while the roller pair 6 for a short period rotates at a higher speed, so as to generate the tear-off tension.

On a folding-tongs cylinder 30 the torn off sections are then provided with reversed and glued bottoms, and for being collected or stacked are set down on a stacking table 31 in vertically upright position.

The following-tongs cylinder 30 is provided with three abutments 12, 12', 12" forming so-called folding bars, which in the manner of tongs cooperate with swivelling jaws 13, 13' of the folding tongs, which can be swivelled about swivel axes 14 mounted on the folding-tongs cylinder 30, and are biased by springs (not shown) in the direction of their closing position. For opening and closing the folding tongs, the same are provided with actuating levers 15, at whose ends cam rollers 16 are mounted.

For opening the folding tongs 12, 13 the cam rollers 16 run along a stationary cam 17, which opens the folding tongs for releasing the folded bottom of a bag or sack prior to putting the bag or sack down, as this can be taken from the folding tongs 12', 13'.

In the folding-tongs cylinder 30 there is pivotally mounted eccentrically with respect to the rotational axis 20 a suction pipe 32, whose swivel axis 19 extends in parallel with the axis 20 of the folding tongs cylinder. The suction pipe 32 is provided with an actuating lever 21, at whose end a cam roller 22 is mounted. The suction pipe 32 is connected with a row of radial suction pipes 18, at whose ends suction nozzles 33 are mounted. The suction pipes 18 are connected with tension springs 25, whose other ends are firmly connected with the folding-tongs cylinder on pins 26. By means of the tension springs 25 the suction pipes 18 are held in contact with fixed stops 24 on the folding-tongs cylinder or are biased in the direction thereto.

For a part of their rotation, the cam rollers 22 of the levers 21 actuating the suction pipes run along cams 23 to impose a pivotal motion on the suction pipes while they are rotating along with cylinder 30. The cam characteristic of the cam 23 and the eccentricity of the axis 19 of the suction pipe 22 are selected such that the suction nozzles 33 move out from the surface of the folding-tongs cylinder 30 when the suction nozzles 33 are located more or less vertically above the stacking table 31, and then make a more or less tangential movement perpendicular to the stacking surface of the stacking table 31.

The stacking table 31 is put against the folding-tongs cylinder 30 below its horizontal diametral plane, and has vertically projecting deflection fingers 36 engaging in peripheral grooves in the folding-tongs cylinder.

Put against the folding-tongs cylinder 30 is a folding knife cylinder 7, which is provided with a folding knife 11 extending along a surface line. Closely behind the folding knife 11 the folding knife cylinder 7 is provided with a punch 10, which takes a strip of glue from a glue spreading roller 8 sealing off a glue box 9, and transfers the same in the proper format on the sack workpieces.

In the vicinity of their leading ends the torn off tube sections passing between the folding knife cylinder and the folding-tongs cylinder are pressed between the jaws 12, 13 of the closed folding tongs by forming a fold, and at the same time the reversed fold is glued to a wall of the sack as a result of the prior application of glue by punch 10.

The sacks, which on the folding-tongs cylinder have thus been provided with folded and glued bottoms and have been moved on, are then during their further movement attached by suction to the suction nozzles 33, when the same emerge from the envelope cylinder of the folding-tongs cylinder due to the control of the suction pipe 32 and the eccentricity of the axis of the suction pipe 32. Since they are controlled by the cam 23, the suction pipes 18 make a movement decelerating the sacks or bags attached by suction, so that the same are set down on the stacking table 31 at a speed reduced to zero or almost to zero. The deceleration of the pipes 18 is evident in FIG. 2 where the action of cam 23 has caused the pipes 18 to move away from stop 24.

The supply of suction air to the suction nozzles 33 is controlled such that the same exert a suction on the sack workpieces in a portion in which the suction nozzles are horizontal. At the same tune, the folding tongs 12, 13 are opened, so that the folded bottom separates from the folding-tongs cylinder, and the suction nozzles perform the further decelerated transport of the sacks until they are set down on the stacking table 31.

Figure 2:
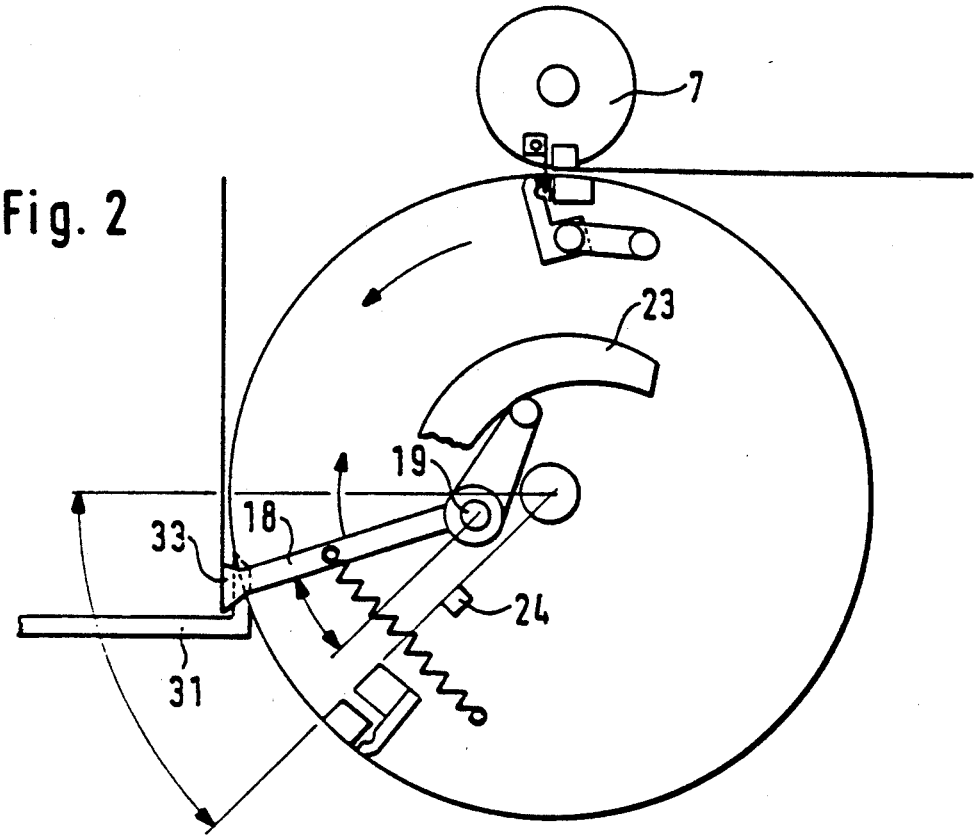
FIG. 2 is a view similar to FIG. 1 showing a row of suction nozzles serving to decelerate the bags or sacks to be set down in a position in which the suction nozzles are releasing said bags or sacks.

As can be seen from FIG. 2, the tangential decelerating transport of the sacks by means of the suction nozzles leads to the fact that the same are safely set down behind the deflection fingers 36 on the stacking surface of the stacking table 31.

To each of the three folding tongs suction nozzles are associated, of which only one is represented in the drawing.

The vacuum applied to the suction pipes 18 is preferably adjusted shortly before the folding tongs open. The vacuum is then stopped again shortly before the sacks are set down on the stacking table 31. When the pipes 18 have passed by the stacking table, rollers 22 move off cam 23 and the pipes snap back into engagement against stop 24.

Figure 3:
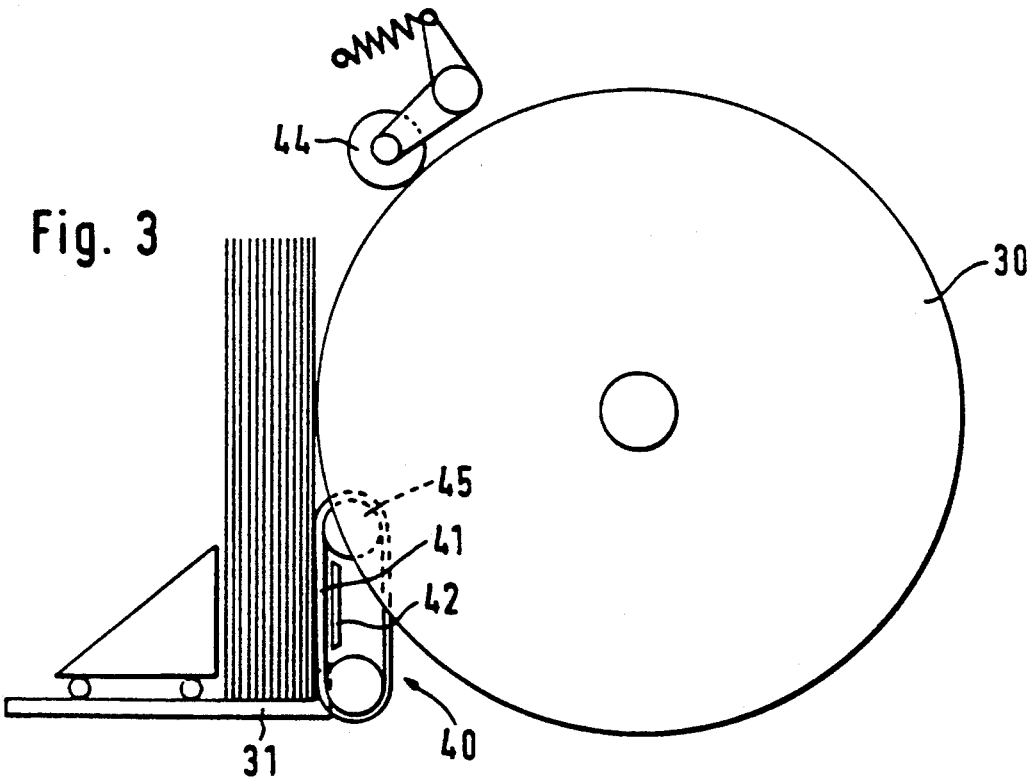
FIG. 3 is a view similar to FIG. 1 showing another embodiment of the apparatus.

In the embodiment in accordance with FIG. 3 the folding-tongs cylinder 30 basically has the same structure as regards the folding tongs and their control as the folding-tongs cylinder in accordance with FIGS. 1 and 2. However, the embodiment in accordance with FIG. 3 differs from that in accordance with FIGS. 1 and 2 in that instead of the suction pipes pivotally mounted about eccentric axes a suction belt 40 is provided, whose conveying strand 41 is running over a suction box 42. Expediently, a plurality of suction belts 40 are provided which, as can be seen from FIG. 3, engage in peripheral grooves of the folding-tongs cylinder 30. In the embodiment in accordance with FIG. 3 the ends provided with folded bottom are running onto the suction belt 40 after they have been released from the holding tongs, and are then attached by suction by the conveying strands 41, as soon as they run over the suction boxes 42. The suction belts 40 and the suction boxes 42 are controlled such that the sacks attached by suction are decelerated down to the speed zero or almost zero. Shortly before the sacks are set down on the stacking table 31, the supply of suction air to the suction boxes 42 is stopped. The suction belt conveyors 40 are stationarily mounted in the machine frame.

To ensure that the sacks released by the folding tongs are properly conveyed by the folding-tongs cylinder until they are running onto the suction belts, a spring-loaded transport roller 44 is put against the folding-tongs cylinder 30. The distance of the transport roller 44 from the upper deflection roller 45 of the suction belt conveyor(s) 40 is larger than the length of a sack, so that a proper conveyance is ensured until the leading ends of the sacks provided with folded bottom are running onto the suction belt conveyor 40.

I claim:

1. An apparatus for stacking flat workpieces, comprising a rotary transport cylinder provided with holding tongs for the workpieces, a stacking table adjacent the transport cylinder, means for opening the holding tongs before reaching the stacking table so as to release the workpieces, and movable suction means for taking the workpieces over from the holding tongs, decelerating the workpieces and placing same on the stacking table at a lower speed than the peripheral speed of the transport cylinder, wherein the suction means comprises at least one suction pipe provided at its end with a suction nozzle and pivotally mounted on the transport cylinder about a swivel axis which is eccentric with respect to a rotation axis of the transport cylinder parallel thereto, and control means for said at least one pipe for providing a decelerating swivel movement for decelerating the workpieces superimposed on the rotary transport cylinder.

2. The apparatus according to claim 1, characterized in that the control means for the at least one suction pipe comprises a leer for pivoting the pipes carrying on its end a follower for running along a stationary cam.

3. The apparatus according to claim 2 characterized in that the cam is shaped to decelerate the at least one suction pipe in the direction of the stacking table down to substantially zero speed.

4. The apparatus according to claim 3 characterized in that the eccentricity of the swivel axis and the cam characteristic are chosen such that the at least one suction nozzle make a decelerate setting-down movement which is substantially tangential to the transport cylinder and substantially vertical to the stacking table.

5. The apparatus according to claim 4, characterized in that the at least one suction pipe comes into engagement by spring force with an abutment on the transport cylinder outside the range of action of the cam.

* * * * *